US011608713B2

(12) United States Patent
Fripp et al.

(10) Patent No.: US 11,608,713 B2
(45) Date of Patent: Mar. 21, 2023

(54) AUTOMATICALLY SHIFTING FRAC SLEEVES

(71) Applicant: Halliburton Energy Services, Inc., Houston, TX (US)

(72) Inventors: Michael Linley Fripp, Carrollton, TX (US); Stephen Michael Greci, Little Elm, TX (US); Richard Decene Ornelaz, Frisco, TX (US); Zachary William Walton, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/771,645

(22) PCT Filed: Jan. 30, 2018

(86) PCT No.: PCT/US2018/016008
§ 371 (c)(1),
(2) Date: Jun. 10, 2020

(87) PCT Pub. No.: WO2019/151993
PCT Pub. Date: Aug. 8, 2019

(65) Prior Publication Data

US 2020/0362668 A1 Nov. 19, 2020

(51) Int. Cl.

| | |
|---|---|
| ***E21B 34/14*** | (2006.01) |
| ***E21B 43/08*** | (2006.01) |
| ***E21B 34/06*** | (2006.01) |
| ***E21B 34/10*** | (2006.01) |
| *E21B 43/26* | (2006.01) |

(52) U.S. Cl.
CPC ..... *E21B 34/142* (2020.05); *E21B 34/063* (2013.01); *E21B 34/10* (2013.01); *E21B 43/08* (2013.01); *E21B 43/26* (2013.01); *E21B 2200/06* (2020.05)

(58) Field of Classification Search
CPC ..... E21B 34/14; E21B 34/12; E21B 2200/06; E21B 43/08
See application file for complete search history.

(56) References Cited

U.S. PATENT DOCUMENTS 7,604,055 B2 * 10/2009 Richard ..... E21B 43/08 166/308.1
7,861,787 B2 1/2011 Russell
(Continued)

FOREIGN PATENT DOCUMENTS

WO 2009029437 A1 3/2009
WO 2017065767 A1 4/2017

*Primary Examiner* — Kenneth L Thompson
(74) *Attorney, Agent, or Firm* — Scott Richardson; Parker Justiss, P.C.

(57) ABSTRACT

A frac sleeve system includes a well casing with a tubular wall having a frac port defined there through for hydraulic fracturing. A sleeve within the well casing includes a sleeve body. The sleeve is mounted for axial movement relative to the tubular wall of the well casing among three positions including: a closed position in which the sleeve body blocks the frac port, a frac position in which the sleeve body clears the frac port so the frac port is open for hydraulic fracturing there through, and a production position in which the sleeve at least partially blocks the frac port.

13 Claims, 12 Drawing Sheets

(56) References Cited

U.S. PATENT DOCUMENTS

| | | | | |
|---|---|---|---|---|
| 7,950,461 | B2 * | 5/2011 | Schrader | E21B 34/10 166/305.1 |
| 8,171,994 | B2 * | 5/2012 | Murray | E21B 23/006 166/308.1 |
| 8,276,674 | B2 * | 10/2012 | Lopez de Cardenas | E21B 43/08 166/373 |
| 8,727,010 | B2 | 5/2014 | Turner et al. | |
| 9,187,994 | B2 * | 11/2015 | Themig | E21B 34/12 |
| 9,341,046 | B2 * | 5/2016 | Huh | E21B 33/124 |
| 9,359,862 | B2 * | 6/2016 | Huh | E21B 34/06 |
| 9,631,468 | B2 * | 4/2017 | Miller | E21B 34/14 |
| 9,638,003 | B2 | 5/2017 | George et al. | |
| 9,976,394 | B1 * | 5/2018 | Campbell | E21B 43/261 |
| 10,180,046 | B2 * | 1/2019 | Werries | E21B 43/12 |
| 10,280,712 | B2 * | 5/2019 | Bacsik | E21B 34/10 |
| 2002/0062960 | A1 | 5/2002 | George et al. | |
| 2009/0044944 | A1 | 2/2009 | Murray et al. | |
| 2009/0084553 | A1 * | 4/2009 | Rytlewski | E21B 43/26 166/305.1 |
| 2012/0048559 | A1 | 3/2012 | Ganguly et al. | |
| 2014/0158361 | A1 | 6/2014 | Cheng et al. | |
| 2014/0246208 | A1 | 9/2014 | Themig et al. | |
| 2016/0273319 | A1 | 9/2016 | Werries et al. | |
| 2016/0298424 | A1 | 10/2016 | Themig | |
| 2018/0010412 | A1 | 1/2018 | Graf et al. | |

* cited by examiner

AUTOMATICALLY SHIFTING FRAC SLEEVES

BACKGROUND OF THE INVENTION

1. Field of the Invention

The present disclosure relates to gas and oil production, and more particularly to frac sleeves for use with down hole tools for fracking.

2. Description of Related Art

A traditional frac sleeve opens a lateral port from a well casing to the annulus around the well tool. Multiple frac sleeves are used along the length of the casing, and the sleeves are opened one at a time to isolate hydraulic fracturing of the formation adjacent each sleeve. A cleanout run is required after the hydraulic fracturing in order to remove proppant from the wellbore.

The conventional techniques have been considered satisfactory for their intended purpose. However, there is an ever present need for improved frac sleeves and methods. This disclosure provides a solution for this need.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
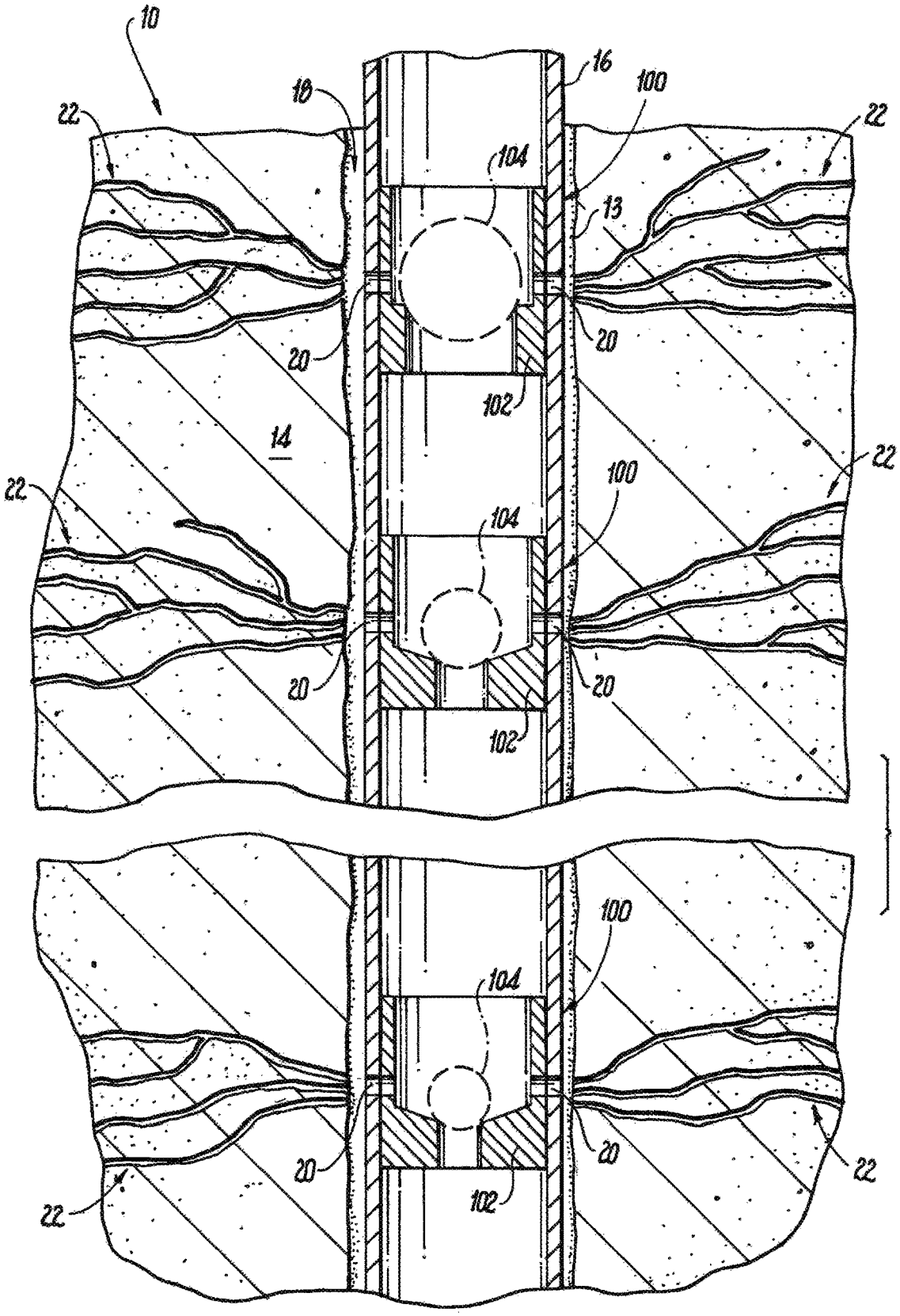
FIG. 1 is a schematic side elevation view of an exemplary embodiment of a system constructed in accordance with the present disclosure, showing a plurality of sleeves in accordance with this disclosure in a well casing in a formation.

Reference will now be made to the drawings wherein like reference numerals identify similar structural features or aspects of the subject disclosure. For purposes of explanation and illustration, and not limitation, a partial view of an exemplary embodiment of a system in accordance with the disclosure is shown in FIG. 1 and is designated generally by reference character 10. Other embodiments of systems in accordance with the disclosure, or aspects thereof, are provided in FIGS. 2-11, as will be described. The systems and methods described herein can be used to isolate frac ports and selectively open and close frac ports as needed for hydraulic fracturing and production.

The system 10 extends from the surface 12 into a formation 14. A well casing 16 extends through an annulus 18 of a well bore 13 and includes frac ports 20 for use in hydraulic fracturing, as indicated schematically by the fractures 22 in FIG. 1. In order to selectively open and close the frac ports 20 so that the hydraulic fracturing can be isolated from one section of the well casing 16 to another, a plurality of frac sleeve systems 100 are included. The frac sleeve systems 100 are shown schematically in FIG. 1. Three frac sleeve systems 100 are shown, however those skilled in the art will readily appreciate that any suitable number of frac sleeve systems 100 can be included. Each frac sleeve system 100 is actuated by a respective ball 104 (shown in broken lines in FIG. 1 since the balls need not all be present in the well bore 13 at the same time). Each ball 104 is of a size that matches the ball receptacle 102 in the given frac sleeve system 100. The ball receptacles 102 are sized so that successively larger balls 104 can be dropped to progressively shift isolation for hydraulic fracturing from positions deeper in the well bore 13 to positions closer to the surface 12, in any suitable order of positions. Those skilled in the art will readily appreciate that the vertical well orientation of FIG. 1 is exemplary and non-limiting as any well direction can be used without departing from the scope of this disclosure. However, for sake of clarity, the up well direction herein refers to the direction fluid or objects must move along the well bore to move closer to the surface 12, and the down well direction herein refers to the direction fluid or objects must move in to move further from the surface 12, regardless of whether the well bore 13 is vertical, angled, horizontal, or a combination of these directions.

Figure 2:
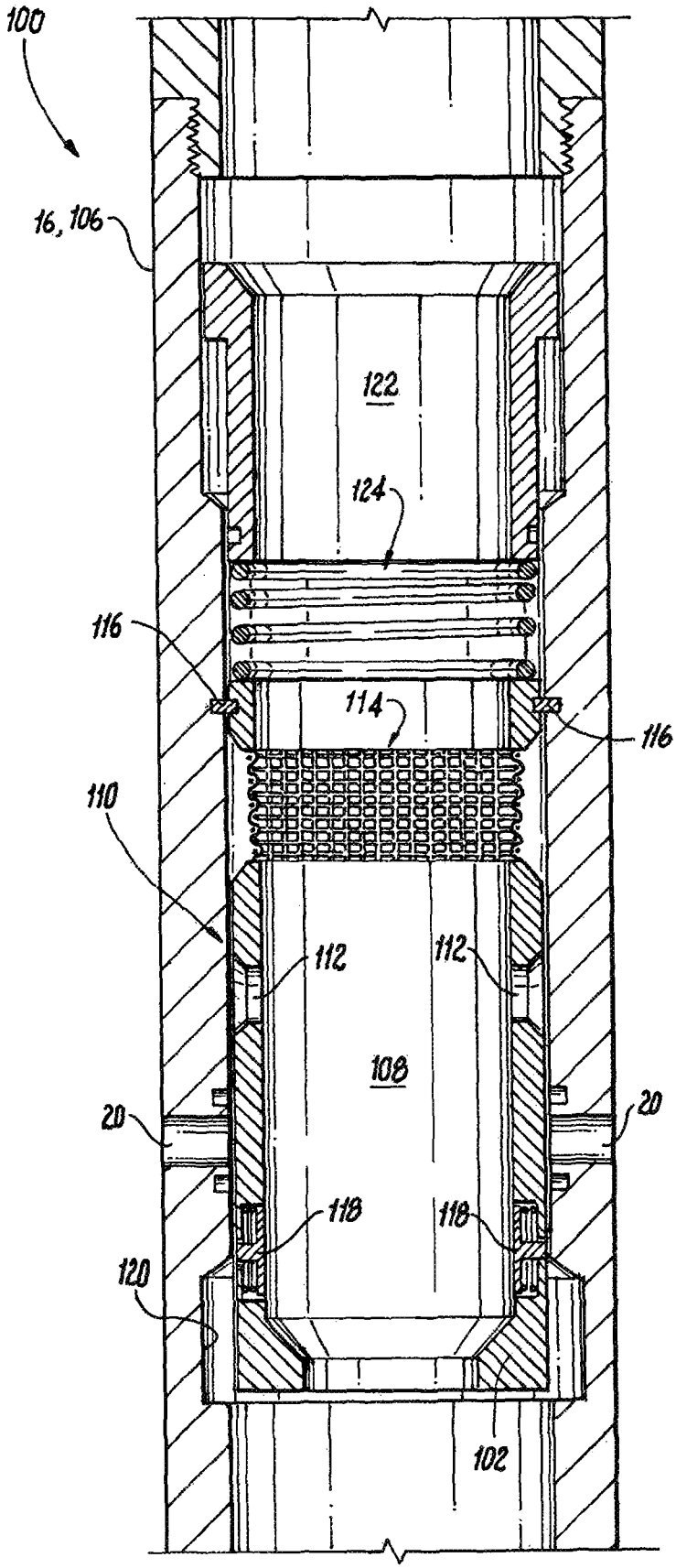
FIG. 2 is a schematic cross-sectional side elevation view of the sleeve systems of FIG. 1, showing the sleeve in the closed position.
Figure 2B:
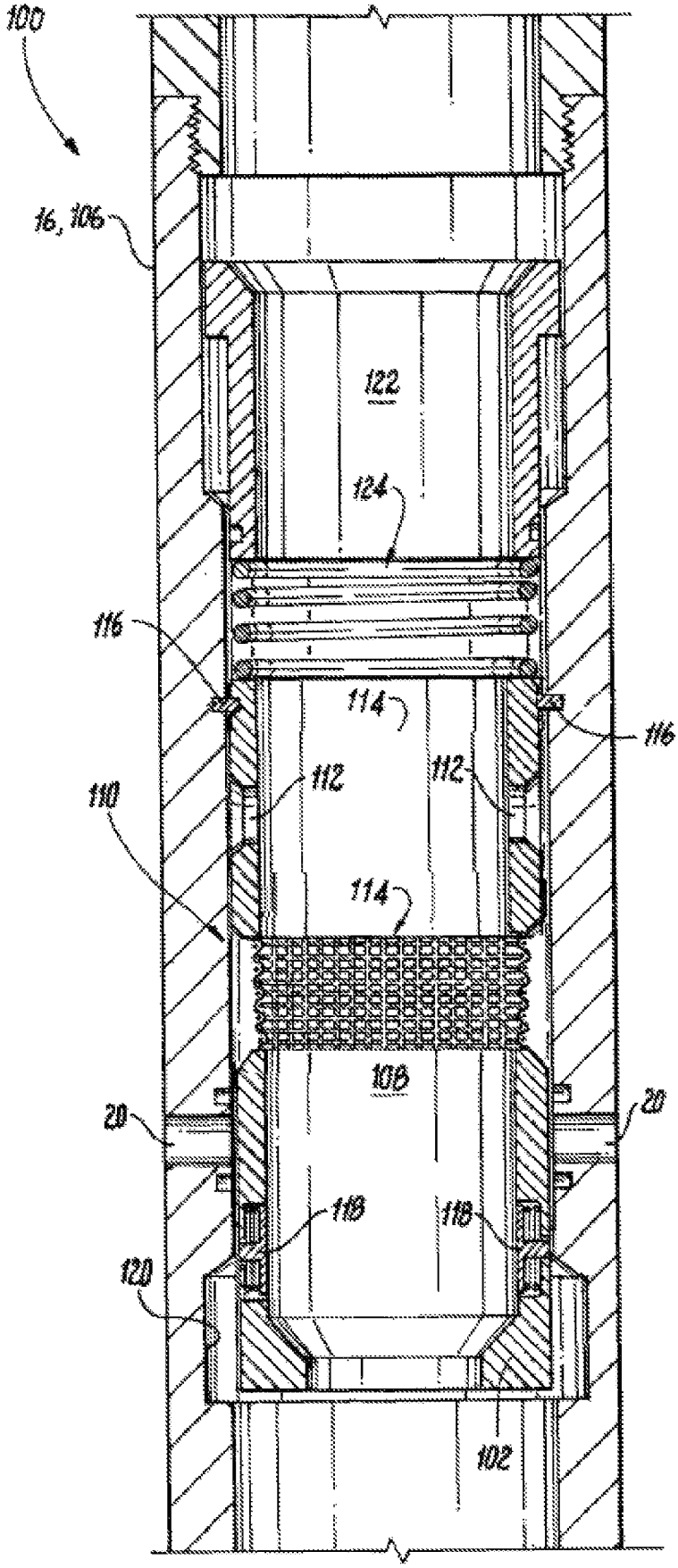
Figure 3:
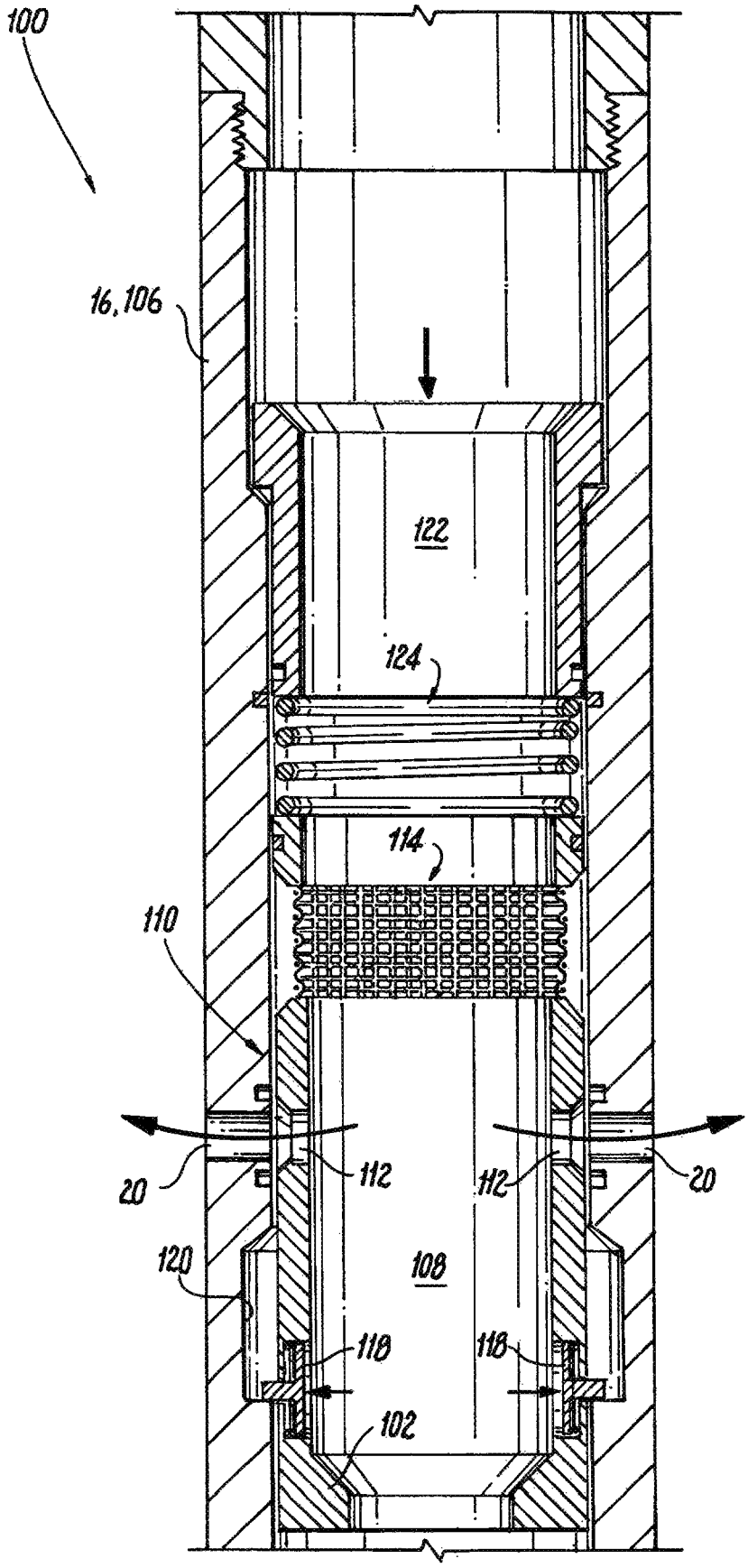
FIG. 3 is a schematic cross-sectional side elevation view of the sleeve system of FIG. 2, showing the sleeve in the frac position.

With reference now to FIG. 2, one embodiment of the frac sleeve system 100 is shown in greater detail. The frac sleeve system 100 includes the well casing 16 with a tubular wall 106. The frac port 20 is defined through the tubular wall 106 for hydraulic fracturing. A sleeve 108 is included within the tubular wall 106 of the well casing 16. The sleeve 108 includes a sleeve body 110 that is mounted for axial movement relative to the tubular wall 106 of the well casing 16 among three positions. First, in FIG. 2, a closed position is shown in which the sleeve body 110 blocks the frac port 20, because a lateral port 112 through the sleeve body 110 is out of alignment with frac port 20. Second, in FIG. 3 a frac position is shown in which the sleeve body 110 clears the frac port 20, e.g., because the frac port 20 is aligned with the lateral port 112, so the frac port 20 is open for hydraulic fracturing therethrough. The downward motion of sleeve 108 and hydraulic fracturing flow are indicated in FIG. 3 by the large arrows. Third, in FIG. 4 a production position is shown in which the sleeve 108 at least partially blocks the frac port 20. In the embodiment of FIG. 2, the closed position of the sleeve is down well the production position of the sleeve, and the frac position of the sleeve is between the closed position of the sleeve and the production position of the sleeve. In contrast, in the embodiment of FIG. 2B, the closed position of the sleeve is up well of the the frac position of the sleeve, and the production position of the sleeve is between the closed position of the sleeve and the frac position of the sleeve.

Figure 4:
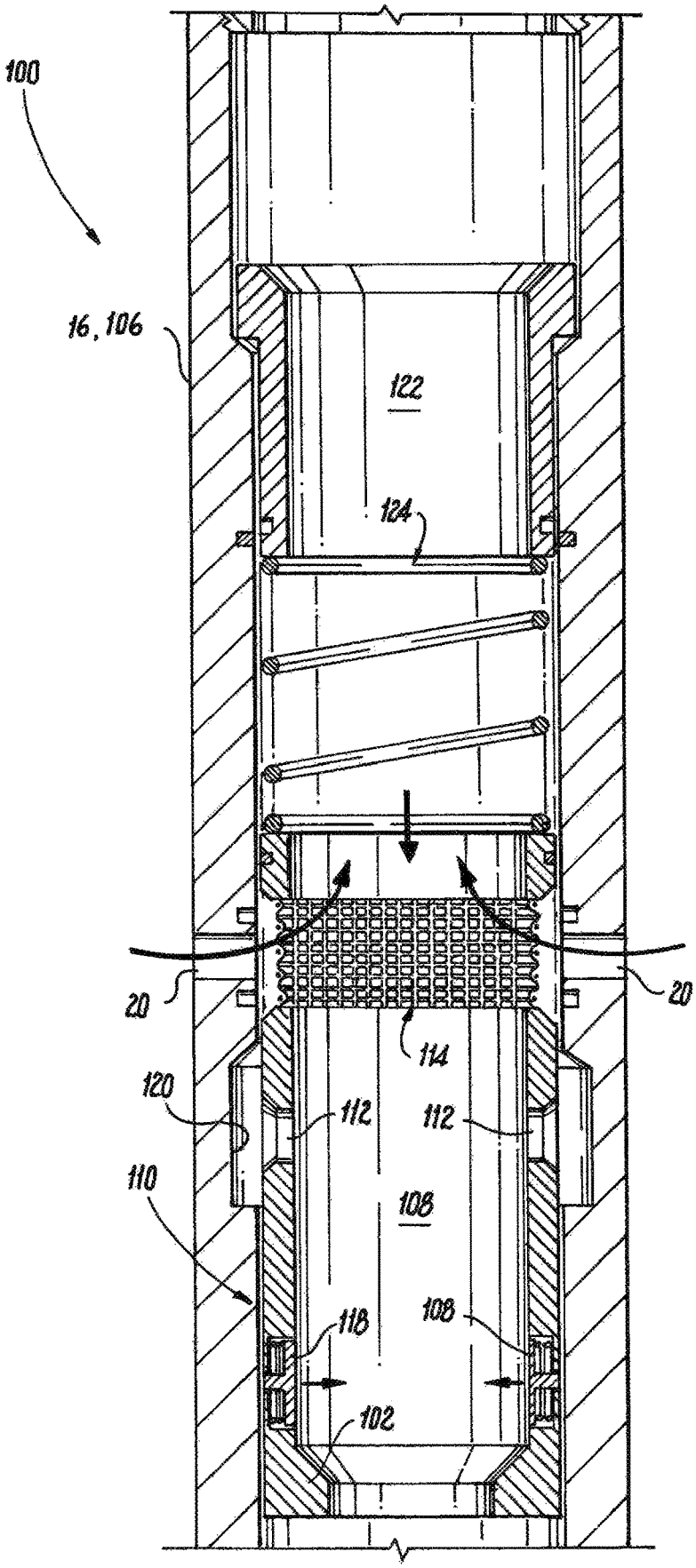
FIG. 4 is a schematic cross-sectional side elevation view of the sleeve of FIG. 2, showing the sleeve in the production position.

With continued reference to FIG. 4, the sleeve 108 includes a screen 114 mounted to the sleeve body 110 up well of the lateral port 112. In the frac position shown in FIG. 3, the sleeve body 110 and the screen 114 both clear the frac port 20, because of the alignment of the frac port 20 and the lateral port 112, so the frac port 20 is open for hydraulic fracturing therethrough. In the production position shown in FIG. 4, the sleeve body 110 clears the frac port 20 so the frac port 20 is open for production, and the screen 114 blocks the frac port 20 to allow production fluids (the flow of which is indicated by the large arrow in FIG. 4) to pass through the frac port 20, but to block proppant passing from the formation 14 (shown in FIG. 1) into the well casing 16 through the frac port 20.

Sleeve system 100 is a down-down system, in which a down well movement moves the sleeve 108 from the closed position in FIG. 2 to the frac position in FIG. 3, and another down well movement moves the sleeve 108 from the frac position in FIG. 3 to the production position in FIG. 4. As shown in FIG. 2, a shear pin 116 can connect between the sleeve body 110 and an inner surface of the tubular wall 106 of the well casing 16 to hold sleeve 108 in the closed position. The shear pin 116 is configured to break under pressure applied in the well casing 16 and/or in response to a ball 104 (shown in FIG. 1) being seated in the ball receptacle 102 to allow movement of the sleeve 108 from the closed position of FIG. 2 to the frac position of FIG. 3.

In another aspect with reference to FIG. 3, the sleeve body 110 includes a pressure actuated piston 118 that engages a recess 120 in the inner surface of the tubular wall 106 of the well casing 16 when the sleeve body 110 is in the frac position. The pressure within the well casing 16 during hydraulic fracturing keeps the pressure actuated piston 118 pressed outward into engagement with the tubular wall 106 to prevent movement of the sleeve 108 during hydraulic fracturing. The pressure actuated piston 118 is configured to disengage from the well casing 16 to allow movement of the sleeve 108 from the frac position of FIG. 3 to the production position of FIG. 4 after pressure in the well casing 16 is relieved after hydraulic fracturing, as indicated by the arrow in FIG. 4. The sleeve 108 can thus automatically transition between the frac position and the production position once injection pressure decreases below a threshold pressure. The sleeve 108 includes a tubular piston 122 and a spring 124 wherein the spring 124 connects between the tubular piston 122 and the sleeve body 110 and is biased to push the sleeve body 110 into the production position of FIG. 4 from the frac position of FIG. 3 after the pressure actuated piston 118 disengages from the well casing 16. The spring 124 is compressed into the frac position of FIG. 3 when pressure applied inside the tubing of the well casing 16 acts on the tubular piston 122 moving it downward as oriented in FIG. 3. The sleeve 108 is thus configured to shift among the three positions and then lock into the production position to prevent further shifting.

Figure 5:
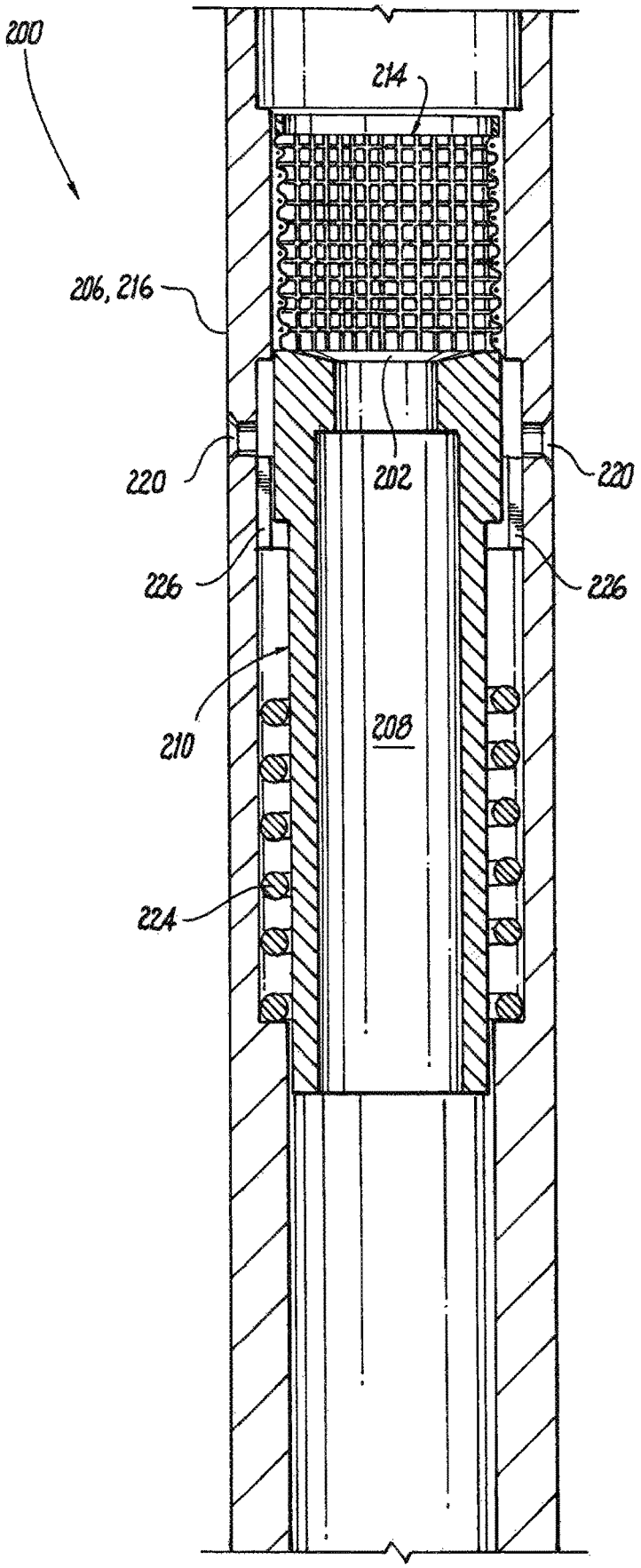
FIG. 5 is a schematic cross-sectional side elevation view of another exemplary embodiment of a sleeve system in accordance with the present disclosure, showing the sleeve in the closed position.
Figure 6:
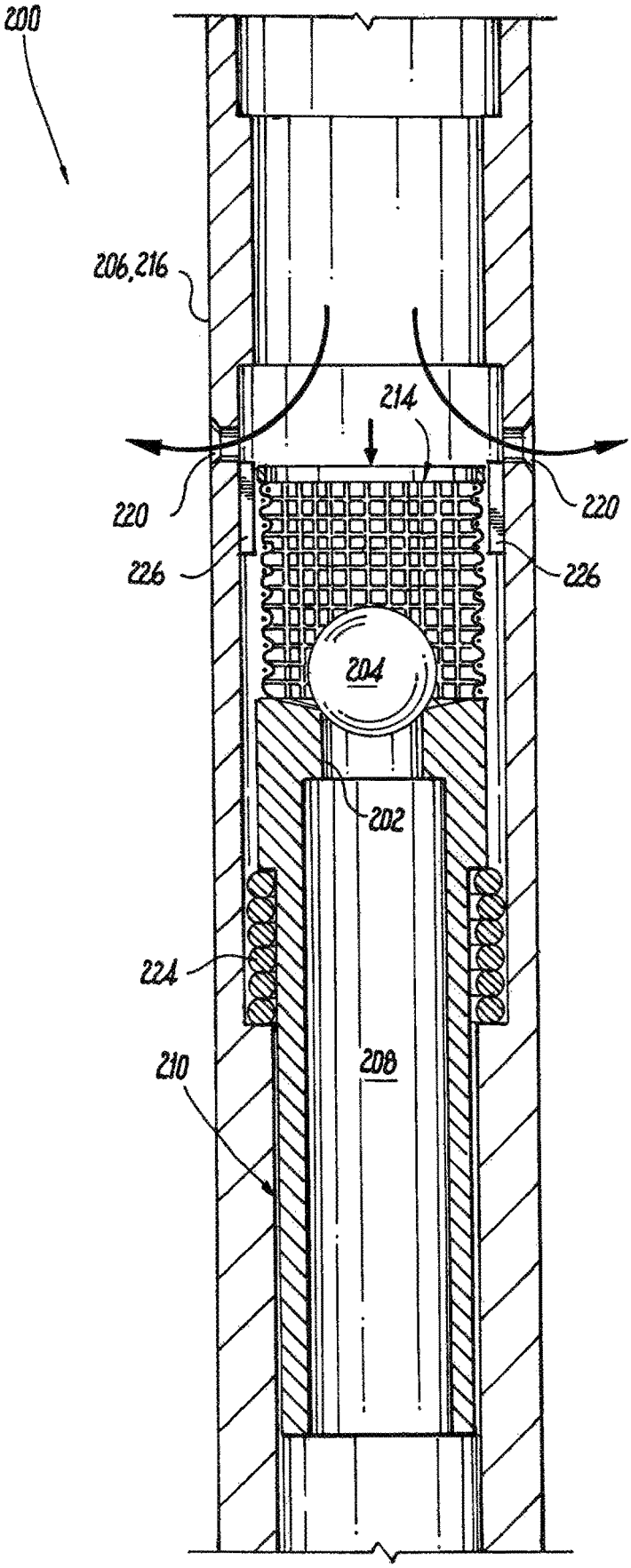
FIG. 6 is a schematic cross-sectional side elevation view of the sleeve system of FIG. 5, showing the sleeve in the frac position.
Figure 7:
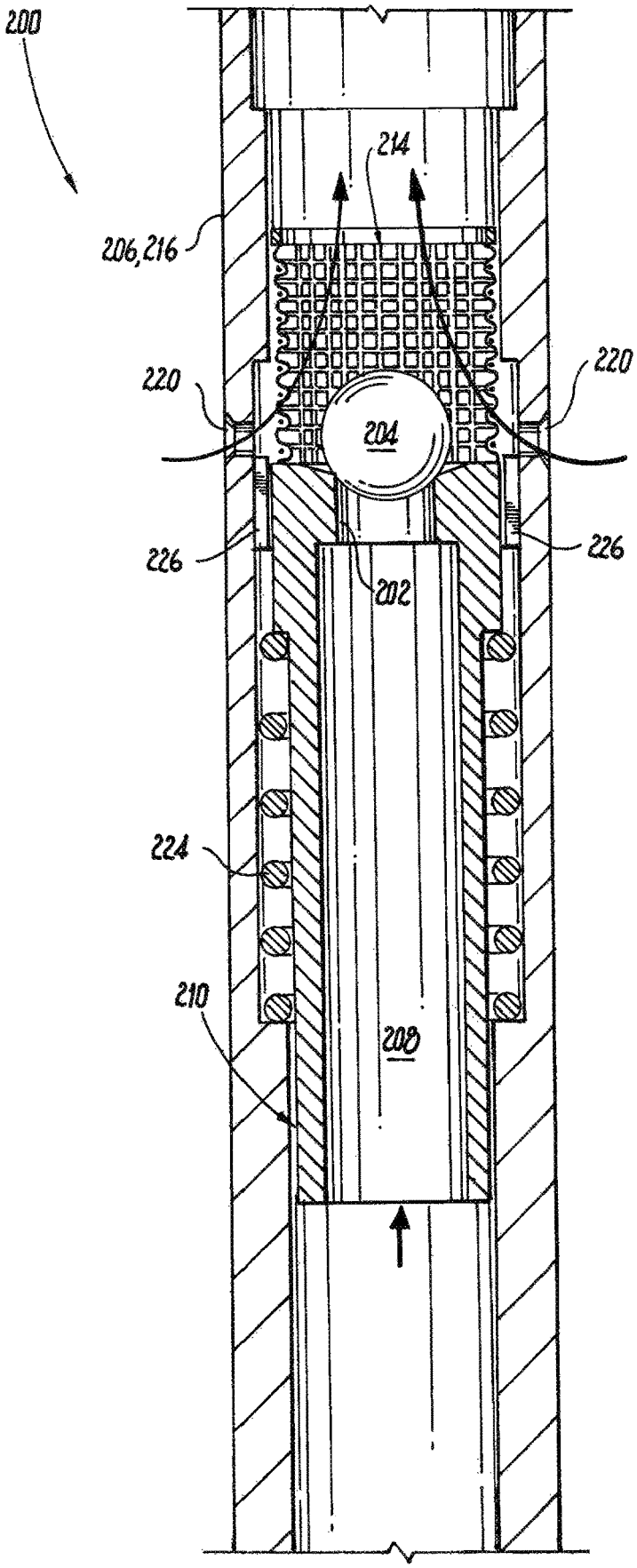
FIG. 7 is a schematic cross-sectional side elevation view of the sleeve system of FIG. 5, showing the sleeve in the production position.

With reference now to FIGS. 5-7, another exemplary embodiment of a sleeve system 200 is shown, which is a down-up system wherein the sleeve 208 moves down from the closed position shown in FIG. 5 to the frac position shown in FIG. 6, and back in an up well direction from the frac position of FIG. 6 to the production position shown in FIG. 7. Sleeve system 200 includes a well casing 206 with a tubular wall 216, and the sleeve 208 includes a sleeve body 210 much as in sleeve system 100 described above. However, the sleeve body 210 does not define lateral ports therethrough for alignment with frac ports 220. A screen 214 is mounted to the sleeve 208 up well of the sleeve body 210. In the closed position of FIG. 5, the sleeve body 210 blocks the frac ports 220. In the frac position of FIG. 6, the sleeve body 210 clears the frac ports 220 for hydraulic fracturing. In the production position of FIG. 7, the sleeve body 210 clears the frac ports 220, but the frac ports are partially blocked by the screen 214 to prevent proppant flowing into the well casing 206 as described above.

A spring 224 is seated between the sleeve body 210 and the tubular wall 216 to bias the sleeve 208 in an up well direction. The spring 224 has a spring constant configured to compress and allow the sleeve to reach the frac position of FIG. 6 with hydraulic fracturing pressure within the well case 206 and under the weight of a ball 204 seated in ball receptacle 202. The spring constant of the spring 224 is also configured to push the sleeve 208 in an up well direction to the production position of FIG. 7 with production pressure in the well case 206. The production position of the sleeve 208 shown in FIG. 7 is lower than the closed position of the sleeve 208 shown in FIG. 5, but not as low as the frac position of sleeve 208 shown in FIG. 6, as oriented in FIGS. 5-7. A ratcheting mechanism 226, e.g., including a J-slot, can engage the sleeve 208 to the well casing 206 to allow downward passage of the sleeve 208 from the closed position of FIG. 5 to the frac position of FIG. 6, but to prevent rising of the sleeve 208 past the production position of FIG. 7 after hydraulic fracturing. Detents, collets, or any other suitable mechanisms can be used in addition to or in lieu of ratcheting mechanisms 226. It is also contemplated that any suitable mechanism can be used, e.g., without a J-slot, for ratcheting without rotating the sleeve 208, without departing from the scope of this disclosure.

Figure 8:
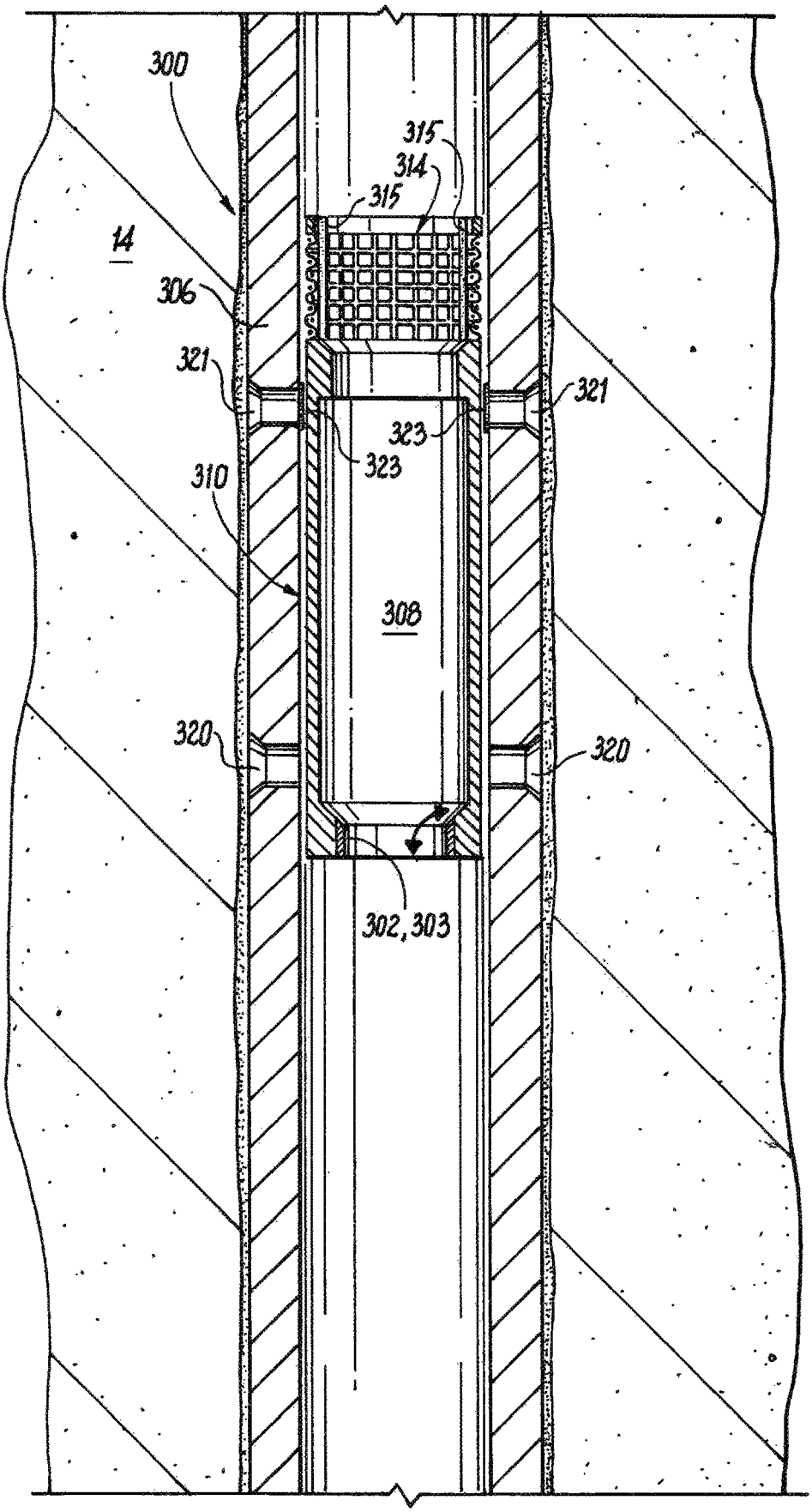
FIG. 8 is a schematic cross-sectional side elevation view of another exemplary embodiment of a sleeve system in accordance with the present disclosure, showing the sleeve in the closed position.
Figure 9:
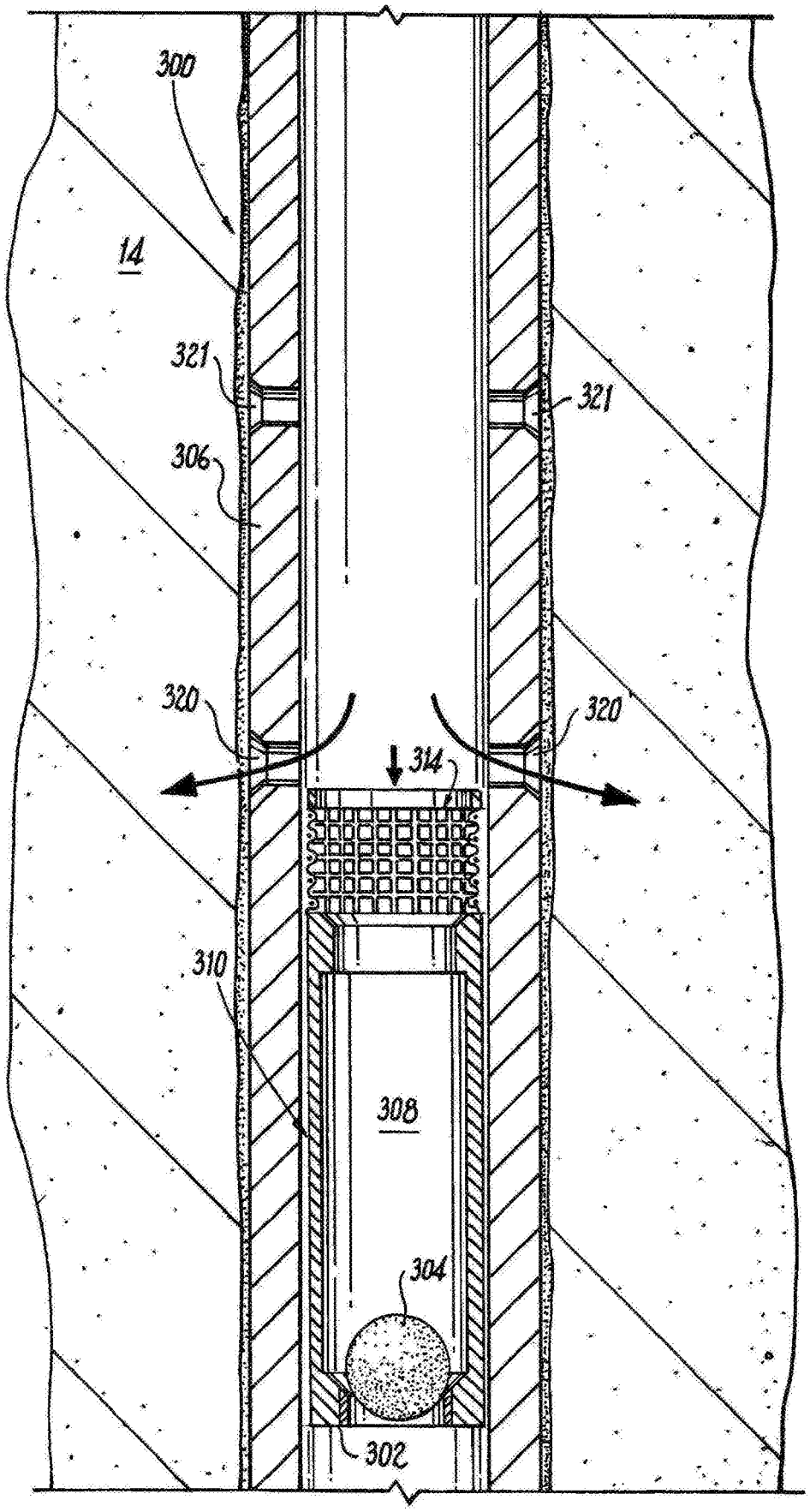
FIG. 9 is a schematic cross-sectional side elevation view of the sleeve system of FIG. 8, showing the sleeve in the frac position.
Figure 10:
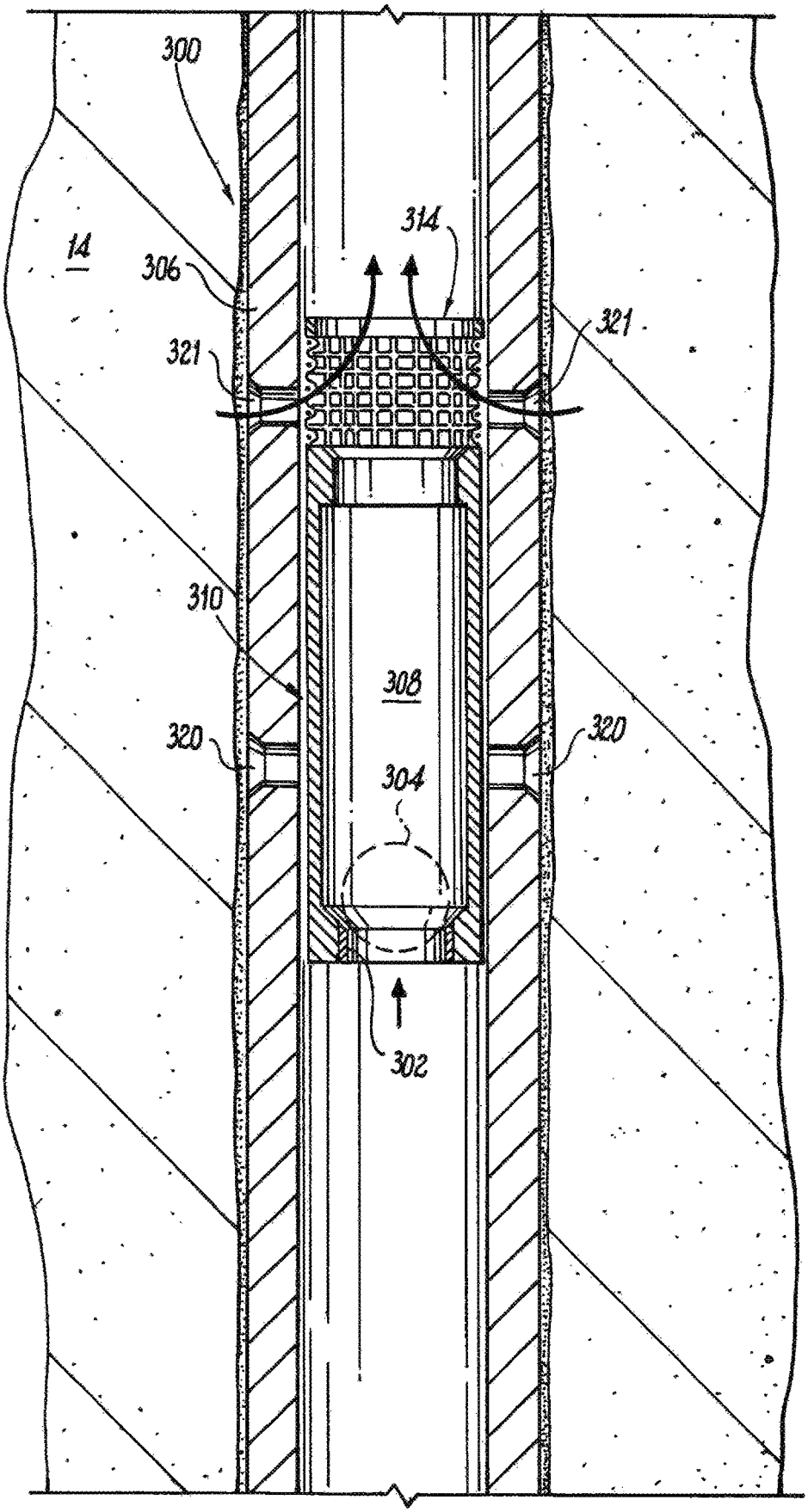
FIG. 10 is a schematic cross-sectional side elevation view of the sleeve system of FIG. 8, showing the sleeve in the production position.

Referring now to FIGS. 8-10, another down-up sleeve system 300 is shown. Much like the sleeve system 200 described above, the sleeve system 300 includes a well casing 306 with frac ports 320 therethrough, a sleeve 300 with a sleeve body 310, ball receptacle 302 for receiving the ball 304, and a screen 314. Much like the sleeve system 200 described above, the sleeve moves in a down well direction from the closed position of FIG. 8 to the frac position of FIG. 9, and in an up well direction from the frac position of FIG. 9 to the production position of FIG. 10.

The well casing 300 includes production ports 321 defined through the tubular wall thereof for production of fluids from the formation into the well casing 306. In the closed position the sleeve body 310 blocks the frac ports 320 and the production ports 321, as shown in FIG. 8. In the frac position shown in FIG. 9, the sleeve body 310 clears the frac ports 320 and the production ports 321 so the frac ports 320 and the production ports 321 are open for hydraulic fracturing therethrough. In the production position of FIG. 10, the sleeve body 310 blocks the frac ports 320 but clears the production ports 321 so the production ports 321 are open for production of fluids from the formation 14. The sleeve 308 includes a screen 314 mounted to the sleeve body 310. The screen 314 blocks the production ports 321 with the sleeve 308 in the production position of FIG. 10 to allow production fluids to pass through the production ports 321, but to block proppant passing through the production ports 321 much as described above. Prior to hydraulic fracturing, the production ports 321 can optionally be covered with a dissolvable material 323, which dissolves to allow production after hydraulic fracturing. The production ports 321 are up well from the frac ports 320. The production ports 321 can each include at least one of an inflow control device (ICD), an autonomous inflow control device (AICD), and/or an autonomous inflow control valve (AICV) for control of fluids flowing therethrough. The screen 314 can therefore be optional.

In accordance with any of the foregoing embodiments, the screen 114, 214, or 314 can optionally be covered with a dissolvable material, e.g., dissolvable material 315 shown in FIG. 8. In accordance with any of the foregoing embodiments, the he sleeve 108, 208, or 308 can include a release, e.g., release 303 indicated in FIG. 8 with the double arrows, configured to extend the ball seat 102, 202, or 302 to receive the ball 104, 204, or 304, wherein the release 303 is at least one of mechanically and/or electrically triggered. The ball 104, 204, and/or 304 can include a dissolvable material. Dissolvable materials as described herein can include metal, plastic, elastomers, or any other suitable type or types of dissolvable material.

Figure 11:
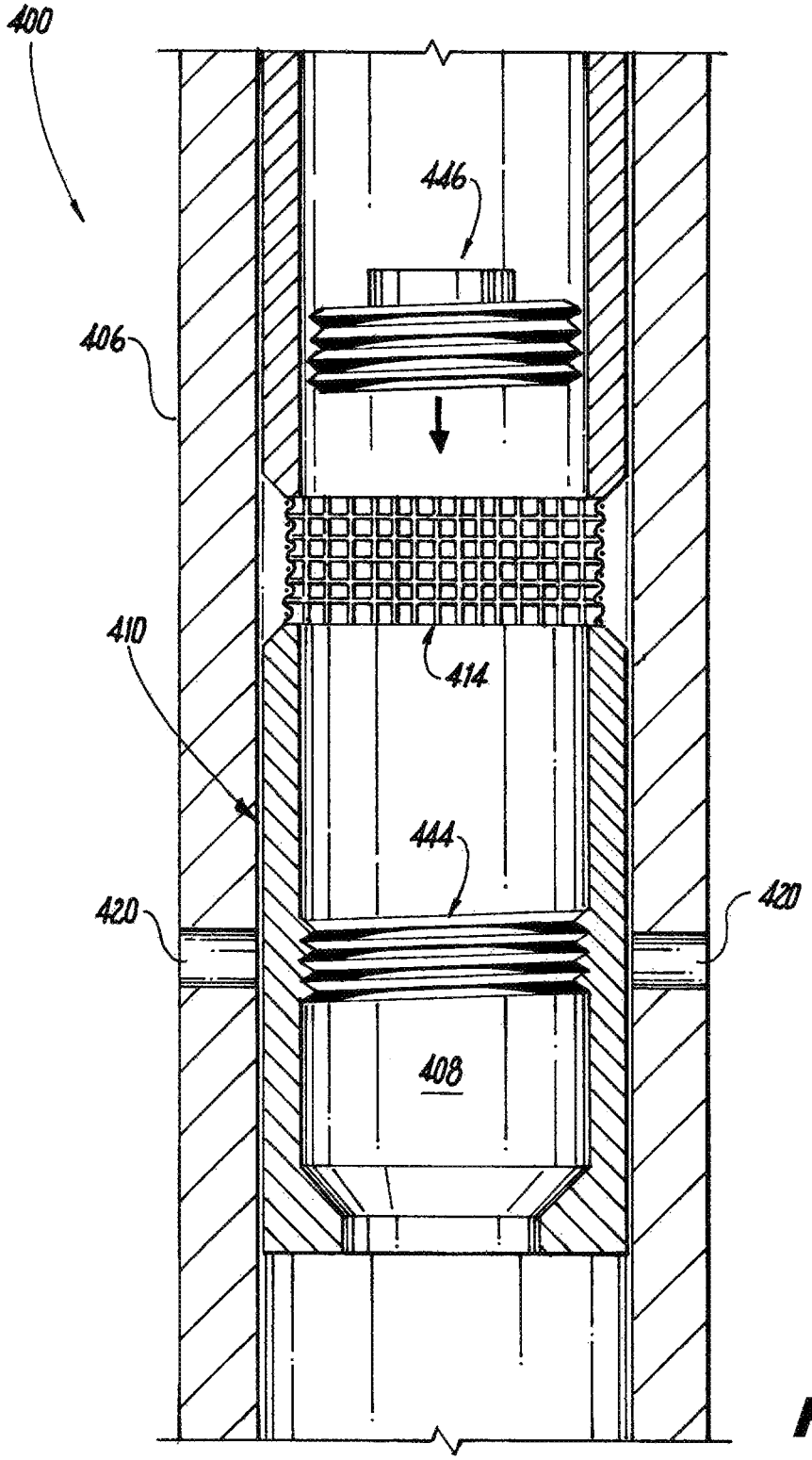
FIG. 11 is a schematic cross-sectional side elevation view of another exemplary embodiment of a sleeve system in accordance with the present disclosure, showing a keyed dart which can be used in lieu of a ball to actuate the sleeve.

With reference now to FIG. 11, another exemplary embodiment of a sleeve system 400 is shown. A sleeve 408 including a sleeve body 410 and a screen 414 is situated inside a well casing 406 to block or clear a frac port 420 much as described above. The sleeve body 410 of sleeve 408 includes a keyed receptacle 444 that is keyed to receive a matching keyed dart 446 to move the sleeve 408 from the open position to the frac position. In accordance with any of the foregoing embodiments, and in lieu of a ball 104, 204, or 304 and ball seat 102, 202, or 302, a keyed dart 446 and receptacle 444 can be used, wherein each keyed dart 446 is keyed to one and only one receptacle 444 among a plurality of sleeve systems in the well system. The dart 446 can optionally include a dissolvable material.

Systems and methods as described herein can provide potential advantages relative to traditional techniques such as the following. The sleeves can automatically shift to a position where a screen keeps proppant in the formation after hydraulic fracturing rather than allowing the proppant to flow into the wellbore. Sleeves in accordance with this disclosure can automatically shift between positions dependent on changes in the injection pressure without a need for intervention. This can eliminate the need for cleanup runs after hydraulic fracturing. This can help ensure the throat of a frac is always filled with proppant. Systems and methods as disclosed herein can also allow the economical use of ICDs, AICDs, and/or AICVs in frac operations.

Accordingly, as set forth above, the embodiments disclosed herein may be implemented in a number of ways. For example, in general, in one aspect, the disclosed embodiments relate to a frac sleeve system. The system includes a well casing with a tubular wall having a frac port defined therethrough for hydraulic fracturing. A sleeve within the well casing includes a sleeve body. The sleeve is mounted for axial movement relative to the tubular wall of the well casing among three positions including: a closed position in which the sleeve body blocks the frac port, a frac position in which the sleeve body clears the frac port so the frac port is open for hydraulic fracturing therethrough, and a production position in which the sleeve at least partially blocks the frac port.

In general, in another aspect, the sleeve can include a screen mounted to the sleeve body, wherein in the frac position the sleeve body and the screen clear the frac port so the frac port is open for hydraulic fracturing therethrough, and wherein in the production position the sleeve body clears the frac port so the frac port is open for production, and the screen blocks the frac port to allow production fluids to pass through the frac port, but to block proppant passing through the frac port. The sleeve body can define a lateral port therethrough which is aligned with the frac port in the frac position of the sleeve for hydraulic fracturing therethrough, and is out of alignment with the frac port in the closed position and in the production position. The closed position of the sleeve can be up well of the frac position of the sleeve, which can be up well of the production position of the sleeve, relative to an up well to down well direction within the casing. A shear pin can connect between the sleeve body and the well casing with the sleeve in the closed position, wherein the shear pin is configured to break under pressure applied in the well casing to allow movement of the sleeve from the closed position to the frac position.

In another aspect, the sleeve body can include a pressure actuated piston that engages the well casing with the sleeve body in the frac position, wherein the pressure actuated piston is configured to disengage from the well casing to allow movement of the sleeve from the frac position to the production position after pressure in the casing is relieved after hydraulic fracturing. The sleeve can include a tubular piston and a spring wherein the spring connects between the tubular piston and the sleeve body and is biased to push the sleeve body into the production position from the frac position after the pressure actuated piston disengages from the well casing.

In another aspect, the closed position of the sleeve can be up well from the frac position of the sleeve, wherein the production position of the sleeve is between the closed position of the sleeve and the frac position of the sleeve. The screen can be mounted to the sleeve up well of the sleeve body. A spring can be seated to bias the sleeve in an up well direction, wherein the spring has a spring constant configured to compress and allow the sleeve to reach the frac position of the sleeve with hydraulic fracturing pressure within the well case, and to push the sleeve in an up well direction to the production position with production pressure in the well case. A ratcheting mechanism can engage the sleeve to the well casing to allow downward passage of the sleeve from the closed position to the frac position, but to prevent rising of the sleeve past the production position after hydraulic fracturing.

In another aspect, the well casing can have a production port defined through the tubular wall thereof for production of fluids from a formation into the well casing, wherein in the closed position the sleeve body blocks the frac port and the production port, wherein in the frac position the sleeve body clears the frac port and the production port so the frac port and the production port are open for hydraulic fracturing therethrough, and wherein in the production position the sleeve body blocks the frac port and clears the production port so the production port is open for production. The sleeve can include a screen mounted to the sleeve body, wherein the screen blocks the production port with the sleeve in the production position to allow production fluids to pass through the production port, but to block proppant passing through the production port.

In another aspect, the production port can be covered with a dissolvable material. The production port can be up well from the frac port. The production port can include at least one of an inflow control device (ICD), an autonomous inflow control device (AICD), and/or an autonomous inflow control valve (AICV).

In accordance with any of the foregoing embodiments, the screen can be covered with a dissolvable material.

In accordance with any of the foregoing embodiments, the sleeve can include a ball seat configured to receive a ball to move the sleeve from the closed position to the frac position. The sleeve can include a release configured to extend the ball seat to receive the ball, wherein the release is at least one of mechanically and/or electrically triggered. The ball can include a dissolvable material.

In accordance with any of the foregoing embodiments, and in lieu of a ball and ball seat, the sleeve can include a keyed receptacle configured to receive a keyed dart to move the sleeve from the open position to the frac position. The dart can include a dissolvable material.

In another aspect, the sleeve can be configured to automatically transition between the frac position and the production position once injection pressure decreases below a threshold pressure.

The methods and systems of the present disclosure, as described above and shown in the drawings, provide for frac sleeves with superior properties including automatic closing of frac ports and screening of fluids from the formation to prevent proppant entering the well casing after hydraulic fracturing. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A frac sleeve system comprising:

a well casing with a tubular wall having a frac port defined therethrough for hydraulic fracturing; and a sleeve within the well casing, wherein the sleeve includes a sleeve body including a lateral port extending therethrough and a screen mounted thereto, and wherein the sleeve is mounted for axial movement relative to the tubular wall of the well casing among three positions including:

a closed position in which the sleeve body blocks the frac port;

a frac position in which the lateral port in the sleeve body is at least partially aligned with the frac port so the frac port is open for hydraulic fracturing therethrough; and a production position in which the screen is at least partially aligned with the frac port to allow production fluids to pass through the frac port, but to block proppant passing through the frac port, wherein the closed position of the sleeve is up well the frac position of the sleeve, and wherein the production position of the sleeve is between the closed position of the sleeve and the frac position of the sleeve, further comprising a shear pin connecting between the sleeve body and the well casing with the sleeve in the closed position, wherein the shear pin is configured to break under pressure applied in the well casing to allow movement of the sleeve from the closed position to the frac position.

2. The system as recited in claim 1, wherein the lateral port is aligned with the frac port in the frac position of the sleeve for hydraulic fracturing therethrough, and is out of alignment with the frac port in the closed position and in the production position.

3. The system as recited in claim 1, wherein the sleeve body includes a pressure actuated piston that engages the well casing with the sleeve body in the frac position, wherein the pressure actuated piston is configured to disengage from the well casing to allow movement of the sleeve from the frac position to the production position after pressure in the casing is relieved after hydraulic fracturing.

4. The system as recited in claim 3, wherein the sleeve includes a tubular piston and a spring wherein the spring connects between the tubular piston and the sleeve body and is biased to push the sleeve body into the production position from the frac position after the pressure actuated piston disengages from the well casing.

5. The system as recited in claim 1, wherein the screen is mounted to the sleeve up well of the sleeve body.

6. The system as recited in claim 1 further comprising a spring seated to bias the sleeve in an up well direction, wherein the spring has a spring constant configured to compress and allow the sleeve to reach the frac position of the sleeve with hydraulic fracturing pressure within the well case, and to push the sleeve in an up well position to the production position with production pressure in the well case.

7. The system as recited in claim 6, further comprising a ratcheting mechanism engaging the sleeve to the well casing to allow downward passage of the sleeve from the closed position to the frac position, but to prevent rising of the sleeve past the production position after hydraulic fracturing.

8. The system as recited in claim 1, wherein the screen is covered with a dissolvable material.

9. A frac sleeve system comprising:

a well casing with a tubular wall having a frac port defined therethrough for hydraulic fracturing; and a sleeve within the well casing, wherein the sleeve includes a sleeve body including a lateral port extending therethrough and a screen mounted thereto, and wherein the sleeve is mounted for axial movement relative to the tubular wall of the well casing among three positions including:

a closed position in which the sleeve body blocks the frac port;

a frac position in which the lateral port in the sleeve body is at least partially aligned with the frac port so the frac port is open for hydraulic fracturing therethrough; and a production position in which the screen is at least partially aligned with the frac port to allow production fluids to pass through the frac port, but to block proppant passing through the frac port, wherein the closed position of the sleeve is up well the frac position of the sleeve, and wherein the production position of the sleeve is between the closed position of the sleeve and the frac position of the sleeve, wherein the sleeve body includes a pressure actuated piston that engages the well casing with the sleeve body in the frac position, wherein the pressure actuated piston is configured to disengage from the well casing to allow movement of the sleeve from the frac position to the production position after pressure in the casing is relieved after hydraulic fracturing.

10. The system as recited in claim 9, wherein the sleeve includes a tubular piston and a spring wherein the spring connects between the tubular piston and the sleeve body and is biased to push the sleeve body into the production position from the frac position after the pressure actuated piston disengages from the well casing.

11. A frac sleeve system comprising:

a well casing with a tubular wall having a frac port defined therethrough for hydraulic fracturing; and a sleeve within the well casing, wherein the sleeve includes a sleeve body including a lateral port extending therethrough and a screen mounted thereto, and wherein the sleeve is mounted for axial movement relative to the tubular wall of the well casing among three positions including:

a closed position in which the sleeve body blocks the frac port;

a frac position in which the lateral port in the sleeve body is at least partially aligned with the frac port so the frac port is open for hydraulic fracturing therethrough; and a production position in which the screen is at least partially aligned with the frac port to allow production fluids to pass through the frac port, but to block proppant passing through the frac port, wherein the closed position of the sleeve is up well the frac position of the sleeve, and wherein the production position of the sleeve is between the closed position of the sleeve and the frac position of the sleeve, wherein the screen is mounted to the sleeve up well of the sleeve body.

12. A frac sleeve system comprising:

a well casing with a tubular wall having a frac port defined therethrough for hydraulic fracturing; and a sleeve within the well casing, wherein the sleeve includes a sleeve body including a lateral port extending therethrough and a screen mounted thereto, and wherein the sleeve is mounted for axial movement relative to the tubular wall of the well casing among three positions including:

a closed position in which the sleeve body blocks the frac port;

a frac position in which the lateral port in the sleeve body is at least partially aligned with the frac port so the frac port is open for hydraulic fracturing therethrough; and a production position in which the screen is at least partially aligned with the frac port to allow production fluids to pass through the frac port, but to block proppant passing through the frac port, wherein the closed position of the sleeve is up well the frac position of the sleeve, and wherein the production position of the sleeve is between the closed position of the sleeve and the frac position of the sleeve, further comprising a spring seated to bias the sleeve in an up well direction, wherein the spring has a spring constant configured to compress and allow the sleeve to reach the frac position of the sleeve with hydraulic fracturing pressure within the well case, and to push the sleeve in an up well position to the production position with production pressure in the well case.

13. The system as recited in claim 12, further comprising a ratcheting mechanism engaging the sleeve to the well casing to allow downward passage of the sleeve from the closed position to the frac position, but to prevent rising of the sleeve past the production position after hydraulic fracturing.

* * * * *